United States Patent [19]

Everman et al.

[11] Patent Number: 4,690,732

[45] Date of Patent: Sep. 1, 1987

[54] APPARATUS FOR SHALE OIL RETORTING

[75] Inventors: Wayne H. Everman, Vanceburg; Joseph H. Gilbert, Quincy, both of Ky.

[73] Assignee: Combs Enterprises, Inc., Alexandria, Va.

[21] Appl. No.: 842,729

[22] Filed: Mar. 20, 1986

Related U.S. Application Data

[60] Continuation of Ser. No. 689,997, Jan. 9, 1985, abandoned, which is a division of Ser. No. 645,258, Aug. 29, 1984, abandoned.

[51] Int. Cl.[4] ..... C10B 1/10

[52] U.S. Cl. ..... 202/100; 196/14.52; 201/10; 202/108; 202/131; 202/218; 202/219; 202/262; 208/432; 422/272

[58] Field of Search ..... 202/81-84, 202/96, 99, 105, 108, 218, 219, 265, 262, 100, 215, 128, 131; 196/14.52, 102, 112, 118; 422/272, 280, 284; 201/10; 222/370; 414/172, 211; 208/390, 402, 415, 432

[56] References Cited

U.S. PATENT DOCUMENTS

| | | | |
|---|---|---|---|
| Re. 16,127 | 7/1927 | Day | 208/11 LE |
| 627,983 | 8/1899 | Corser | 222/370 |
| 1,765,702 | 6/1930 | Roser | 202/136 |
| 1,778,515 | 10/1930 | Hampton | 208/11 LE |
| 2,451,081 | 10/1948 | Ford | 422/280 |
| 3,606,896 | 9/1971 | Holm | 202/170 |
| 3,884,397 | 5/1975 | Andersson | 222/370 |
| 3,977,960 | 8/1976 | Stout | 201/10 |
| 4,236,995 | 12/1980 | Kruger | 208/11 LE |
| 4,495,032 | 1/1985 | Everman | 201/10 |

FOREIGN PATENT DOCUMENTS

| | | | |
|---|---|---|---|
| 159246 | 2/1921 | United Kingdom | 201/10 |

*Primary Examiner*—Barry S. Richman
*Assistant Examiner*—Joye L. Woodard
*Attorney, Agent, or Firm*—Lowe, Price, LeBlanc, Becker & Shur

[57] ABSTRACT

A shale oil retorting system and novel continuous feed means for retorting oil shale within a retort housing employs a tilted circular conveyor within the housing which allows for continuous feeding of crushed oil shale within the conveyor for subsequent immersion in a hot process oil bath and unloading from the housing. The retort housing is constructed of side body members arranged to provide primary refluxing action of flammable process oil vapors evolved during retorting to prevent explosion. Safety is further augmented by providing an overhead vapor outlet and a sufficient level of process oil in the bath to produce a slight overpressure in the free board region conducive to quickly exhausting shale oil vapor from the housing into an overhead condensing unit. The spent shale particles discharged from the housing are immediately quenched to recover process oil coating the particles and minimize generation of flammable vapors from the hot particles. Ultrasound waves propagated through the liquid oil bath increase production of shale oil vapors.

16 Claims, 5 Drawing Figures

APPARATUS FOR SHALE OIL RETORTING

This application is a continuation of application Ser. No. 689,997, filed Jan. 9, 1985, now abandoned, which is a division of Ser. No. 645,258, filed Aug. 29, 1984, now abandoned.

TECHNICAL FIELD

The present invention relates generally to shale oil retorting systems for evolving shale oil from solid oil shale and, more particularly, to a retorting system utilizing a heated liquid bath into which shale material is dipped to evolve a vapor condensable into shale oil. In other aspects, the present invention also relates to retorting apparatus capable of handling the solid oil shale in a continuous feed process and to compositions of process oils suitable for obtaining high volume production of shale oil in a safe and efficient manner.

BACKGROUND ART

The term "oil shale", as used herein, refers to a carbonaceous rock, i.e., Devonain marine composition, particularly Eastern oil shale, that contains a high molecular weight organic polymer called kerogen. Kerogen is the oil precurser in the oil shale rock. To extract kerogen from oil shale, the oil shale is generally first crushed into small pieces and heated in retorts to pyrolysis temperatures in the range between about 500° F. to about 1200° F. Retorting of the oil shale at pyrolysis temperatures causes decomposition of the kerogen and evolution of shale oil trapped in the matrix of the ore, in the form of a vapor which can be subsequently condensed to form usable shale oil liquid.

A number of different retorting apparatus and processes are known for treatment of Eastern oil shale to evolve shale oil therefrom. Some of the major shale oil retorting systems as well as lesser known processes are discussed in U.S. Pat. No. 4,410,416 to Karl Everman, the disclosure of which is incorporated herein by reference in its entirety. Generally speaking, however, the major shale oil retorting processes utilize either a hot gas as the heating medium circulating within a drum containing the shale particles or a hot liquid into which the particles are dumped for a considerably large residence time as compared to the present invention. Following immersion in the hot liquid, the particles must then be separated from the hot liquid in an expensive and time-consuming process, such as by rotating the drum in which the particles have been retorted so that the particle material can be dispensed by gravity through a stationary outlet.

The aforesaid prior art Everman patent discloses a split hub wheel apparatus allowing shale particles to be loaded into spoke-like containers of the wheel, dipped into a hot oil bath that enters the containers through perforations and subsequently unloaded after shale oil vapor is evolved as a result of dipping the materials in the bath. However, the prior art Everman split hub wheel can only function as a batch processing unit which sharply increases the production time required to evolve a particular quantity of shale oil vapor from the shale particles.

Another drawback of the prior art Everman apparatus is the strict requirement that shale oil retorting occurs within an airtight retort, requiring the use of expensive seals. To a large extent, safe operation of the Everman retort depends upon the integrity of the seals; if the seals fail and air comes into contact with the hot oil used in the liquid bath, an explosion would necessarily result.

Another drawback of the prior Everman retort is the requirement that a large number of feed and discharge pipes, and moving parts be present in the hostile environment, of the retort which may be adversely effected thereby. For example, in the prior Everman apparatus, shale is augered into the split wheel hub within the retort for loading into the spoke containers. Since the auger is sealed to prevent air from entering the split hub wheel retort, the hot gaseous environment within the retort tends to come into contact with the auger seal causing degradation thereof. Too, by augering the raw shale particles into the split wheel hub, the particles are unnecessarily subjected to severe agitation which tends to increase the production of fines collecting as a sludge within the hot oil bath.

It is accordingly an object of the present invention to provide a novel oil shale retorting system capable of retorting shale in a continuous feed process to obtain high production yields of shale oil in a safe and efficient manner.

Another object of the invention is to provide a method and apparatus providing a direct flow path for enabling evolved shale oil vapor to quickly exit from the retort for condensation into liquid form to minimize the presence of the flammable shale oil vapor within the retorting system.

Still another object is to provide a retorting structure and novel process oil wherein vapors of the process oil produced during the retorting process are subjected to fast refluxing action to minimize the presence of flammable vapors within the retort.

Yet a further object of the present invention is to provide a retorting apparatus and method which does not require retorting to occur under air-tight conditions, without sacrificing safety.

Still a further object is to provide a continuous feed conveyor within the retorting system that features a minimum of moving parts within the rugged and hostile environment prevailing in the retort housing.

DISCLOSURE OF THE INVENTION

A process for producing a combustible liquid from solid oil shale with a retorting system, in accordance with the present invention, comprises the steps of feeding raw shale particles of predetermined size at a feed location into a series of moving compartments capable of retaining the particles therein while allowing a process liquid to contact the particles. The particles are immersed into a bath of the process liquid maintained at a sufficient temperature and for a time sufficient to evolve vapor of the combustible liquid from the particles. The vapor is collected and condensed to produce the liquid. The compartments containing spent particles (i.e., oil shale that has been immersed into the bath) are removed from the bath and transferred to a discharge location wherein the particles are unloaded from the compartment. The process according to the present invention is a continuous feed process since the raw particles at the feed location are fed as a continuous stream into the compartments passing beneath the feed location while unloading of spent particles and immersion of particles into the bath occurs simultaneously at other points within the retorting system.

In accordance with an important feature of the invention, it has been discovered that substantial advantages are obtained when using a heavy process oil in the liquid bath which is considerably heavier than the shale oil vapor evolved from the raw shale particles immersed in the bath. The process oil is of high viscosity and has a lower condensation point than the shale oil vapor to permit rapid refluxing action of the process oil vapors to minimize the presence of flammable vapors within the retort to prevent explosion. It has been determined that a process oil that satisfies these criteria should preferably have an SUS viscosity at 100° F. of about 3000 to 6000, a specific gravity of about 16 to 18 API, a pour point of about 25° to 35° F., a flash point of about 450° to 525° F., a viscosity of about 175 to 225 SUS at 210° F. and an ISO viscosity grade of about 950 to 1050. While this process oil is preferred for use in the retort of the present invention, it should be understood that the process oil can be utilized in other types of retorting systems because of its ability to reflux and thereby prevent explosions from occurring.

In accordance with a further aspect of the invention, the raw particles are fed into a series of annular compartments continuously moving within a retort housing about an inclined axis of rotation relative to the surface of the liquid bath so that raw particles are gravity fed as a continuous stream into the compartments. The feed location is located above the bath so that as feeding occurs the raw particles are initially out of contact therewith. The compartments containing raw particles move continuously in uninterrupted travel from the feed location for immersion in the bath and thereafter for discharge from the housing at a discharge location situated above the bath. The compartments are only partially filled so that particles therein are subjected to a tumbling action which is conducive to shale oil vapor production.

As the vapor evolved from the immersed particles emerges from the bath, it quickly flows under positive pressure into a vapor outlet and directly into a condensing unit located above the retort housing to minimize the amount of time the flammable shale oil vapors are present within the housing.

In accordance with another aspect of the process according to the present invention, a flammable vapor evolved from the process liquid during retorting is subjected to a primary refluxing action by being directed through a free board region above the bath into contact with an inclined surface of the retort housing where dropwise condensation rapidly occurs to minimize the presence of flammable vapors within the free board region. Secondary refluxing action of the process liquid vapor also occurs by directing the process vapor remaining after primary refluxing action occurs through a passage extending vertically upward from the shale oil vapor outlet. Most of the remaining process liquid vapor contacts surfaces defining the passage and condenses thereon to drip back into the bath.

In accordance with another unique aspect of the invention, ultrasound waves are propagated through the liquid bath to act upon by agitating the immersed particles and thereby increase the rate at which vapor evolves from these particles. The ultrasound waves are preferably focused with a focusing device immersed in the bath in the direction of the immersed containers to act directly upon the particles.

In accordance with yet another aspect of the present invention, the spent shale particles, after leaving the bath, are directly gravity unloaded through a discharge passage into intimate contact with a quenching liquid, causing rapid cooling of the spent particles to prevent process liquid adhering to the surfaces of the particles from being absorbed into the particles. Conventional stripping techniques can then be utilized to recover the process liquid for replenishing the bath. Since the hot spent particles emit hot flammable vapors, rapid quenching minimizes the production of these vapors for safe retorting to occur.

The process oil bath is maintained at a sufficient level within the retort housing so that the free board region above the bath has a slight overpressure so that shale oil vapor rapidly and positively flows from the retort housing through the overhead vapor outlet into the condensing unit. The free board region is thereby controlled to also permit primary refluxing action of the process oil vapors without causing a large quantity of these vapors to flow into the vapor outlet.

The shale oil retorting apparatus of the present invention features a tilted circular conveyor including concentric inner and outer guide bands connected together with a plurality of radial dividers establishing the annular compartments. The inner band is connected to a central hub with a pair of hub connector plates to define a rigid circular conveyor structure mounted between guide blocks in sliding contact with an inner inclined surface of a lower base plate forming part of the retort housing. The hub is mounted for rotation on an inclined shaft rotatably mounted at opposite ends thereof to the housing using exterior main carrier bearings. A variable speed motor connected via a shaft and a bevel gearing arrangement provides continuous drive to the conveyor.

The upper main carrier bearing is mounted to an inclined cover plate forming an upper portion of the retort housing. The cover plate is easily removed to provide access to the conveyor for maintenance and repair. An inner inclined surface of the cover plate also provides a large inclined surface within the housing against which primary refluxing action occurs.

The base plate supporting the circular conveyor is formed with a discharge opening adjacent and downstream the feed location through which spent shale particles fall by gravity into a quenching tank through a discharge chute. Most of the process oil in the compartments flows along the lower base plate for recapture in the liquid bath before the compartments pass over the discharge opening. Secondary recovery of process liquid coating the particles quenched in the tank occurs using conventional steam or solvent stripping techniques. To obtain tertiary recovery of the process oil dripping down inner surfaces of the discharge chute, a lower section of the chute is formed with a perforated portion through which the dripping oil passes out of the chute into an annular collection chamber.

A series of deflecting fingers located immediately above the annular perforated portion in the discharge chute deflect spent shale particles towards the center of the flow path to prevent collision thereof with the perforated portion.

Additional objects, advantages and novel features of the invention will be set forth in part in the description which follows and in part will become apparent to those skilled in the art upon examination of the following or may be learned by practice of the invention. The objects and advantages of the invention may be realized and attained by means of the instrumentalities and combinations particularly pointed out in the appended claims.

BEST MODE FOR CARRYING OUT THE INVENTION

The present invention concerns a novel process and retort design and system to evolve shale oil vapor from oil shale particles by immersion of the particles in a heated process oil bath. As will be seen in greater detail below, the invention features a unique retort housing and a tilted circular conveyor therein enabling continuous loading, dipping of shale particles into a process liquid bath in the retort housing, and unloading of the spent particles from the housing in a continuous feed manner that allows for high speed and volume production of shale oil output. The process oil forming the liquid bath is unique and cooperates with the interior of the retort design to rapidly evolve oil vapor from the particles in a non-airtight, atmospheric pressure environment that maximizes safety by minimizing the possibility of explosions.

1. Brief Overview of the Retorting System

Figure 1:
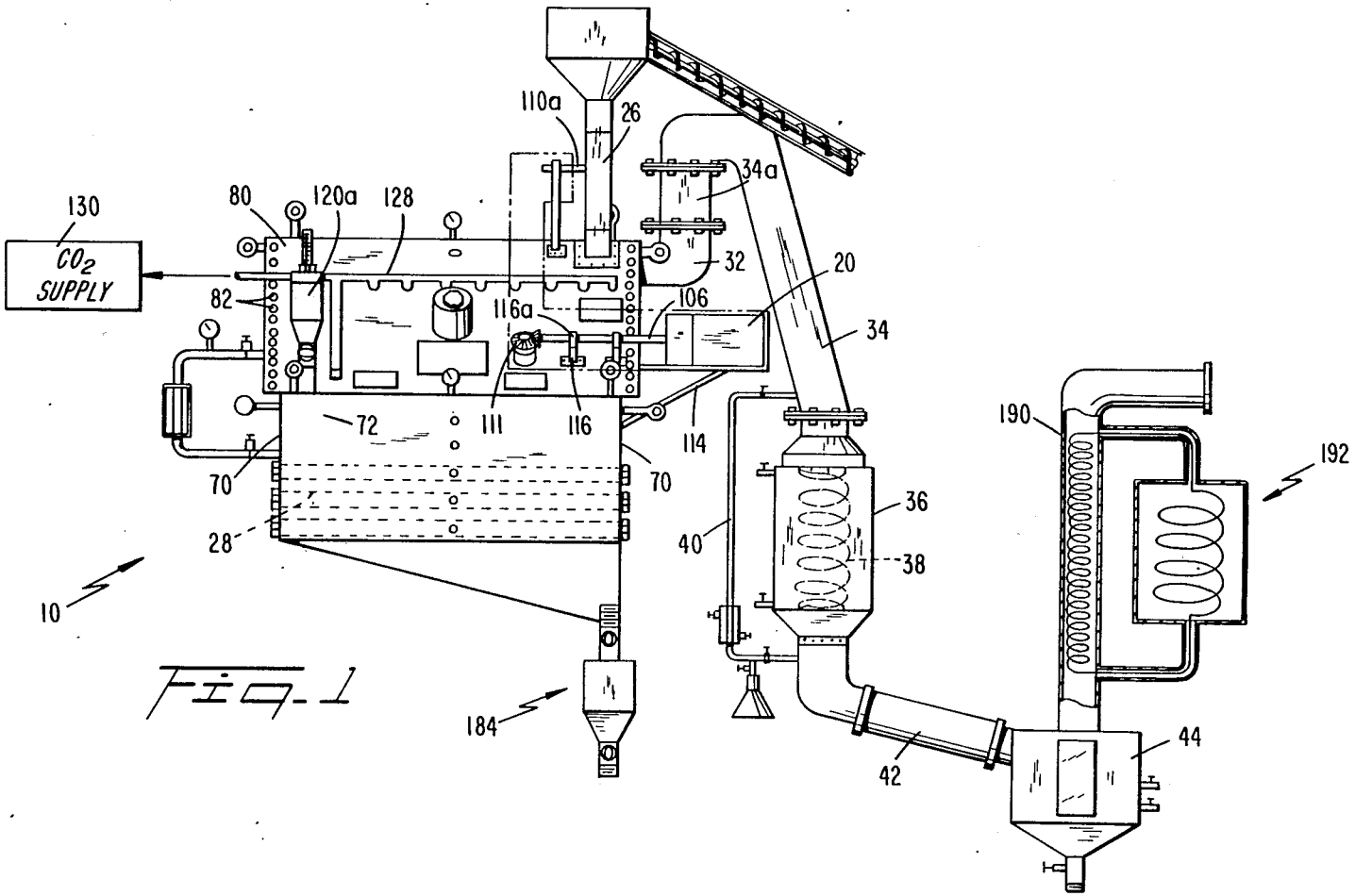
FIG. 1 is a partial sectional view and schematic flow diagram of a shale oil retorting system and process utilizing the novel conveyor and refluxing structures of the present invention.
Figure 2:
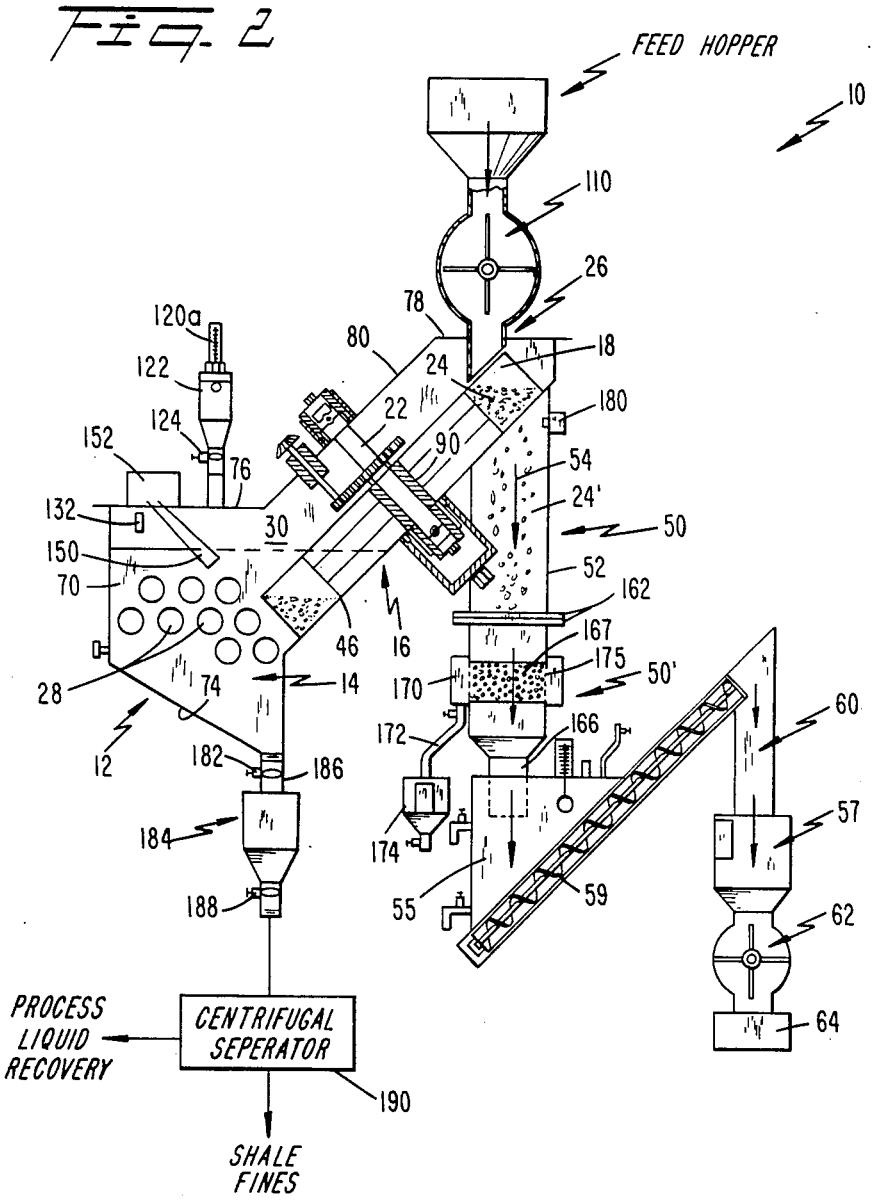
FIG. 2 is a sectional view of the retort housing and conveyor apparatus of the present invention showing continuous loading and immersion of shale oil particles into the process oil bath, and further showing discharge and treatment of spent shale particles within the retorting system.
Figure 4:
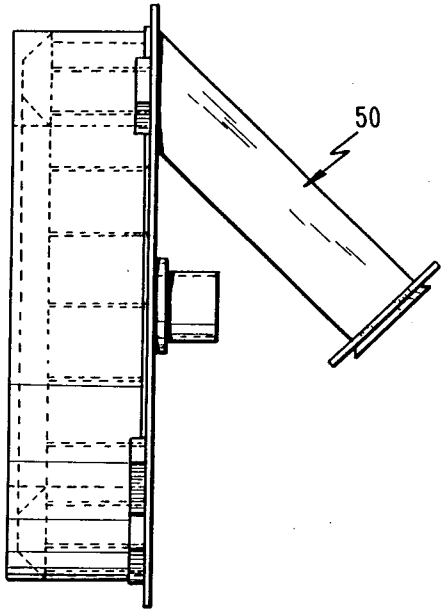
FIG. 4 is a side plan view of the conveyor of FIG. 3.

Referring to FIGS. 1 and 2, retorting system 10 of the present invention comprises a retort housing 12 containing a process liquid bath 14 and a tilted circular conveyor 16 having a series of annular compartments 18 continuously driven by motor 20 for rotation about an inclined drive shaft 22. Raw shale particles 24 are loaded into compartments 18 passing beneath a feed chute 26 for immersion into intimate contact with bath 14. The liquid bath 14 is heated and maintained with heater tubes 28 at a sufficient temperature and for a time sufficient to evolve shale oil vapor from the immersed particles in the unique manner set forth below.

As the shale oil vapor rises from bath 14 through freeboard region 30, it exits housing 12 through an overhead vapor outlet 32 and flows under positive pressure through a condenser pipe 34 into a condenser 36 where it enters a series of coiled conduits 38 water cooled with circuit 40. In condenser 36, the vapor releases its latent heat of vaporization. The condensed product shale oil then passes from condenser 36 through outlet pipe 42 for storage within collection tank 44.

Figure 3:
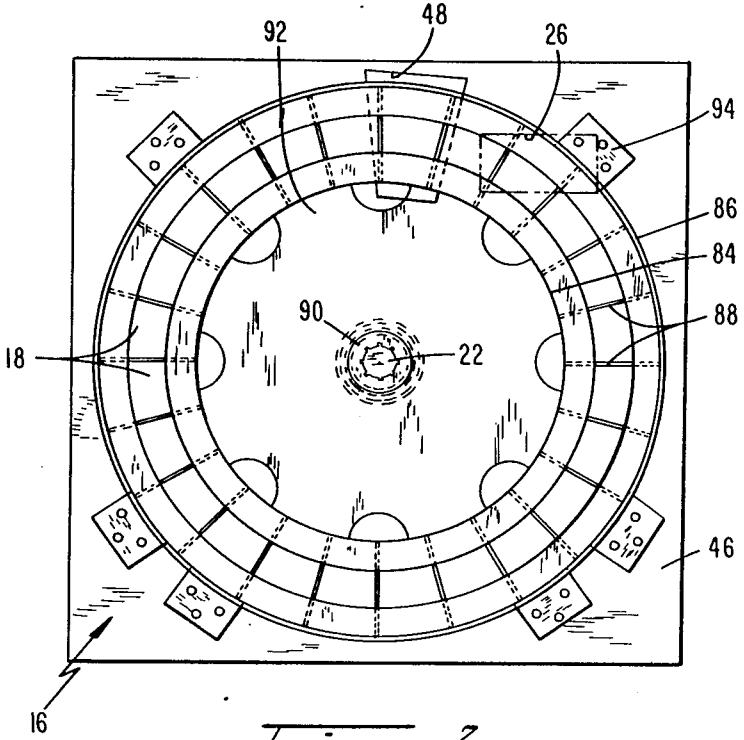
FIG. 3 is a plan view of the tilted circular conveyor of the present invention.

As will be seen more fully below, the annular compartments 18 are supported for travel about shaft 22 on an inclined base plate 46 of housing 12. The base plate 46 is formed with a discharge opening 48, as best depicted in FIG. 3, located adjacent the feed location established by chute 26. Thus, as compartments 18 containing now spent particles 24' rotate upwards out of bath 14, they sequentially pass over discharge opening 48 where the spent particles are unloaded from the retort housing 12 into a discharge chute 50 having side body members 52 establishing an exit flow path 54 for the spent particles 24'.

As compartments 18 exit bath 14, most of the process liquid in intimate contact with the particles drains out of the compartments and flows back along the inner surface of base plate 46 to replenish the bath. To effect secondary recovery of process liquid still coating the spent particles 24', these particles are introduced through chute 50 and tertiary recovery unit 50' (discussed infra) into a water quench tank 55 where the hot porous particles are rapidly cooled to prevent the process liquid coating from being absorbed into the pores of the particles. By utilizing conventional steam or solvent stripping techniques, this coating is recovered to replenish bath 14. The stripped spent particles are then conveyed into a waste container/hopper 57 through auger 59 and discharge chute 60 for metering through star valve 62 for disposal or subsequent use. One such use can be supply of spent shale particles as a charge for a fluidized bed combusion apparatus 64 utilized to supply heat to heater tubes 28.

2. Retort and Conveyor Apparatus

Retort housing 12 is formed of side body members 70, end member 72 and body member 74 welded or otherwise secured together and to inclined base plate 46 to establish a bottom tapered housing portion containing bath 14. The top portion of housing 12 includes a first top body member 76 overlying bath 14 and a second top body member 78 formed with an opening through which passes chute 26. An inclined cover plate 80 extends between top members 76, 78 and is secured to the housing 12 with cover bolts 82 to provide access to the conveyor 16 for maintenance and repair. The cover plate 80 extends parallel to inclined base plate 46 establishing an upper region of housing 12 containing conveyor 16.

The conveyor 16 includes concentric inner and outer guide bands 84, 86 connected together with a plurality of radial dividers 88 equispaced from each other, as shown in FIG. 3. The annular bands 84, 86 and dividers 88, preferably formed of steel, are welded or otherwise secured together to establish annular compartments 18. The inner band 84 is connected to a central hub 90 with a pair of circular hub connector plates 92 to establish with the hub and compartments 18 a rigid circular conveyor structure mounted between guide blocks 94 in sliding contact with the inner surface of base plate 46 (inclined at an angle of between 30° to 60°, preferably 45°) for rotation about shaft 22.

Figure 5:
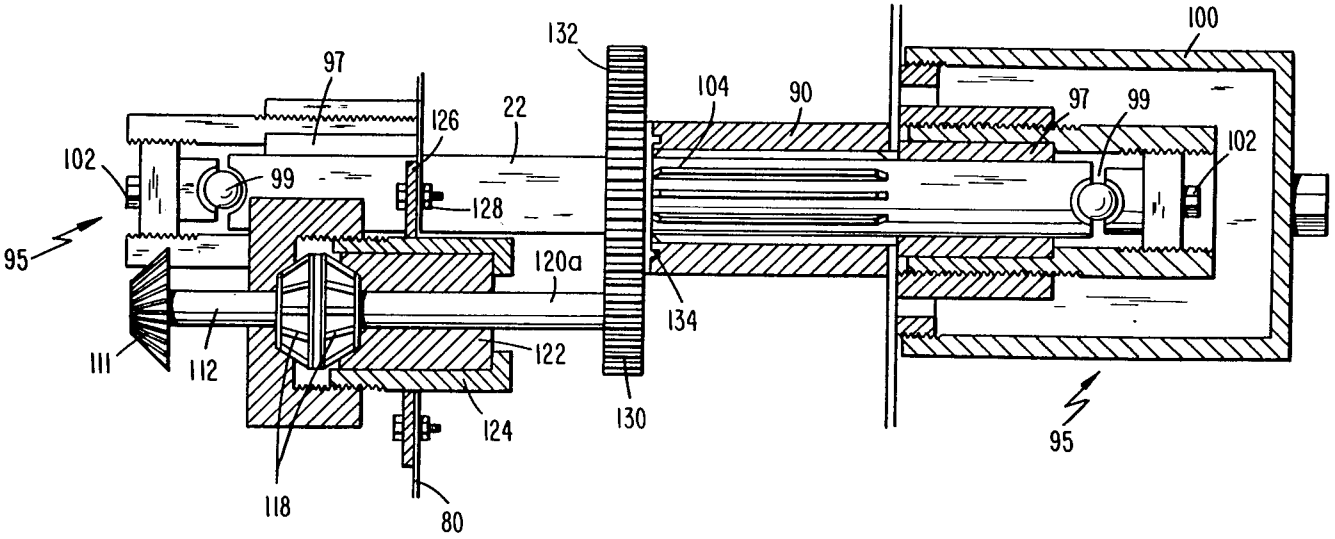
FIG. 5 is a detailed sectional view of a drive mechanism for rotating the tilted conveyor within the housing.

The drive shaft 22 is rotatably mounted at opposite ends thereof to base plate 46 and cover plate 80 with upper and lower main carrier bearings 95 as best shown in FIG. 5. Each main carrier bearing 95 includes a bushing 97 and a thrust bearing 99 mounted outside the housing within a threaded cover 100 which can be easily removed to service the carrier bearings. A tension nut 102 is provided within each carrier bearing 95 to tighten thrust bearings 99 as is occasionally necessary during normal use and wear. Shaft 22 further includes splines 104 in contact with the conveyor hub to impart rotational movement to the hub.

Variable speed motor 20 includes an output shaft 106 carrying a bevel gear 108 in meshing contact with a driven bevel gear 111 mounted on a shaft 112 located outside housing 12. The motor 20 is supported outside housing 12 on bracket mounts 114 while shaft 106 is supported outside cover plate 80 on suitable brackets 116 containing journals 116a. To transmit drive from the driven bevel gear 110 to conveyor shaft 22, the shaft 112 is connected via roller bearings 118 to a driven shaft 120 rotatably mounted in cover plate 80 with bushing 122 supported within bushing retainer 124 secured to the cover plate by flange 126 and nuts 128. Shaft 120 extends into the interior of housing 12 and carries at its lower end thereof a drive gear 130 in meshing contact with driven gear 132 fixed to the conveyor hub with keys 134.

The tilted circular conveyor 16 in cooperation with retort housing 12 provides numerous advantages over other retorting systems of which we are aware. For example, conveyor 16 enables retorting to occur as a continuous feed process to achieve high volume through-put and processing of raw shale particles 24 due to the continuous feeding of raw shale particles into compartments 18 through the feed hopper and chute 26. A star valve 110 can be provided within chute 26 to prevent the gravity fed particles from jamming within the chute. Furthermore, gravity loading of compartments 18 in the aforesaid manner tends to maintain the integrity of the particles by minimizing the production of fines as likely to occur when the shale particles are fed directly into the retort by augering. In addition, by locating the main carrier bearings and the bevel gear/-shaft connecting arrangement outside housing 12, the number of moving parts likely to be adversely affected by the relatively hostile environment within the housing is kept to a minimum, avoiding costly maintenance and down time.

In operation, compartments 18 are only partially filled to approximately 50% capacity. This allows gentle tumbling action of the particles within the compartments to occur as the compartments slide along base plate 46 for immersion into bath 14. This tumbling action achieved with the circular conveyor design has a beneficial effect in increasing the rate at which kerogen molecules are released from the shale particle matrix for increased production of shale oil vapor.

The liquid bath 14 which is discussed extensively below is maintained at a temperature of between 500° F. to 1000° F., and preferably between 700° F. to 750° F. The shale particles remain immersed in the liquid bath for a residence time period between about 0.5 and 6 minutes depending upon the particle size. As the particles 24 in compartments 18 are immersed into intimate contact with the process oil bath, heat flows into the particles from the process oil causing the kerogen molecules to release from the particles in first a liquid, then rapidly vaporized state. These vapors pass through the mineral matrix of the shale particles into the bath as small bubbles that rise rapidly to the surface. These 'bubbles' protect the majority of the kerogen vapor molecules from contact with the hotter process oil resulting in a very small production of gas as compared to gas operated retorts.

Upon reaching the surface of bath 14, the bubbles collapse, releasing their vapor into freeboard region 30 whereupon the vapor rapidly ascends and passes out of housing 12 through overhead vapor outlet 32 for condensation in condenser 36.

The high processing oil temperatures mentioned above tend to cause vaporization of some of the process oil which escapes into freeboard region 30 with the lighter shale oil vapors. If refluxing of these heavier process oil vapors does not occur an explosion within the retort may result particularly if the oil vapors within the free board region come into contact with oxygen at high temperatures within the retort.

To minimize the possibility of explosions without requiring the use of expensive seals to maintain an air-tight environment within the retort as disclosed in the prior Everman patent discussed supra, the freeboard region 30 is constructed so that natural refluxing and dropwise condensation of the heavier process oil vapors occurs against inner surfaces of top members 76, 78 and particularly inclined cover plate 80, allowing the condensed process oil to drip back into bath 14. In the event that some of the heavy process oil vapors escape from the retort housing into overhead vapor outlet 32, secondary refluxing action occurs by constructing condenser pipe 34 with a vertical riser section 34a mounted between the vapor outlet and condenser pipe. Thus, as the heavy process oil vapors pass through the riser section 34a, some of these vapors tend to contact the large inner cylindrical surface of the riser, condensing thereon, to flow back into bath 14.

The aforesaid primary and secondary refluxing action occurring in retort housing 12, in cooperation with overhead outlet 40 allowing the shale oil vapor to flow quickly from freeboard region 30 to condenser 36, minimizes the quantity of flammable vapors within the freeboard region to prevent explosions. By refluxing the heavier process oil vapors as aforesaid, it has been determined by experimentation that the product shale oil collected within collection tank 44 contains less than 5% of process oil condensate, and typically 1 to 3%, providing a superior quality product shale oil while minimizing the need to replenish the amount of process oil in bath 14.

The amount of freeboard region 30 within retort housing 12 should be sufficient to provide approximately ½ to 1 p.s.i of overpressure relative to the ambient pressure within condenser pipe 34 to allow a positive pressure flow of shale oil vapor to condenser 36. Further, if freeboard region 30 is too large, sufficient vapor pressure cannot develop within the freeboard region which inhibits refluxing and increases the likelihood of explosion. If freeboard region 30 is too small, an excessively large vapor overpressure within the region tends to drive the process oil vapor through outlet 32 which also increases the possibility of explosions and disadvantageously results in a higher percentage of process oil distillate mixed in with the product shale oil. To provide a proper amount of freeboard region 30, it has been determined by experimentation that a sufficient quantity of process oil must be present in bath 14 so that the ratio of the diameter of circular conveyor 16 to the headspace between the surface of the bath to top body member 76 (and between the conveyor and cover plate 80) is in the range of approximately 4:1 to 8:1, and preferably 6:1.

To maintain the proper level of process oil within bath 14, a process oil level float indicator 120a can be provided together with an oil reservoir 122 and manual valve, 124.

To further minimize the possibility of explosion within retort housing 12, a $CO_2$ line 128 connected to $CO_2$ supply 130 can be provided to inject $CO_2$ into freeboard region 30 in the event that flames are detected within the housing through viewing window 132.

3. Liquid Process Oil Bath

In accordance with a unique feature of both the method and apparatus of the present invention, it has been discovered that substantial advantages are obtained when using a heavy process oil that generates a vapor within freeboard region 30 which is considerably heavier than the shale oil vapor evolved from shale particles 24 and therefore conducive to refluxing. The process oil is of high viscosity and has a lower condensation point than the shale oil vapor to assist in the refluxing action, while possessing a high flash point to avoid auto-ignition and minimize the possibility of explosion.

To obtain the foregoing advantages and other advantages discussed infra, it has been determined that a process oil that satisfies these criteria should preferably have an SUS viscosity at 100° F. of about 3000 to 6000, a specific gravity of about 16 to 18 API, a pour point of about 25° to 35° F., a flash point of about 450° to 525° F., a viscosity of about 175 to 225 SUS at 210° F. and an ISO viscosity grade of about 950 to 1050. A specific oil in the preferred embodiment is Mobil Viscolite Oil SS, available from Mobil Oil Corporation, which has a specific gravity of about 17.7 API, a pour point of about 30° F., a flash point of about 485° F., a viscosity of about 5000 SUS at 100° F., a viscosity of about 198 SUS at 210° F., and an ISO viscosity grade of about 1000.

In addition to satisfying the foregoing criteria, a heavy process oil having characteristics within the above range also reduces the production of water that tends to be generated by the breakdown of alcohols within the shale during the retorting process, as likely to occur when lighter process oils are employed such as certain types of heavy gear grease and oil derived from shale.

4. Ultrasound Wave Generation

It has also been discovered that propagation of ultrasound waves through bath 14 considerably reduces the resident time required to evolve shale oil vapor within retort 10. As shown in FIG. 2, ultrasound waves can be propagated through bath 14 in the direction of immersed compartments 18 by an ultrasound emitting probe or horn 150 connected to an ultrasound generator 152 mounted on housing 12 outside bath 14. To prevent the piezo-electric transducer (not shown) within horn 150 from burning out when exposed to the hot process oil temperatures in excess of 700° F., a water or antifreeze cooling circuit (also not shown) can be employed.

As best understood, propagation of ultrasound waves through bath 14 in a frequency range of approximately 10,000 to 1,000,000 Hertz causes rapid vibration of each individual particle 24 to occur which, in cooperation with the intense heat conditions prevailing in the bath, causes a rapid breakdown in the bonds that hold the kerogen molecules in the mineral matrix. This vibration is freely permitted by virtue of only filling each compartment 18 with particles 24 to about 50% capacity, as discussed above. In one experiment, a decrease in residence time from about 3 minutes (no ultrasound) to about 45 seconds (application of ultrasound was observed) when retorting was carried out on shale particles of about ½ inch to 2 inches in size.

Another benefit obtained with ultrasound, as best understood, is that the ultrasound waves tend to maintain the pores of the shale particles open to the particle surfaces, providing numerous exit passages for the kerogen vapor to release from the particles. This cleansing action is achieved with ultrasound by preventing minute shale particles from flaking off the pore walls and remaining clogged in the pores. Ultrasound waves also tend to collapse the kerogen vapor bubbles as they form within bath 14 to produce smaller bubbles that rapidly cool when they reach the bath surface and burst, resulting in a lower ambient temperature within freeboard region 30 to reduce the possibility of auto-ignition of flammable vapors.

It has been discovered that Viscolite SS and similar process oils discussed supra are uniquely suited for propagation of ultrasound waves during the retorting process because of their highly viscous nature which resists the tendency of the process oil to gassify. If applied through a lighter grade process oil, agitation of the oil (i.e., molecules) would tend to produce an unsafe amount of process oil vapor within freeboard region 30. To propagate ultrasound waves through Viscolite SS, bath temperatures in the range of about 710° F. to 720° are preferred.

5. Discharge of Spent Shale Particles From The Retort Housing

As mentioned briefly above, as compartments 18 containing spent particles 24' (i.e., oil shale that has been retorted) rotate upwards out of bath 14, they sequentially pass over discharge opening 48 where the spent particles are unloaded into discharge chute 50 for immediate quenching within tank 55. This quenching action, apart from facilitating employment of steam or solvent stripping techniques to recover process oil coating the particles for replenishing bath 14, also serves to rapidly cool the hot particles which emit flammable vapors within chute 50 while the particles are still hot. Thus, immediate quenching of the hot particles serves a dual purpose and minimizes the possibility of explosions from occuring within discharge chute 50.

As the hot particles fall by gravity through chute 50 into the quench tank, some of the process oil coating these particles tends to run down along the inner surfaces of side body members 52 towards the quench tank. To effect tertiary recovery of this process liquid, recovery unit 50' is mounted to the lower end of chute 50 via flanges 162. The unit 50' which can also be formed of side body members similar to members 52, has a lower discharge end 166 establishing a continuous flow path with path 54 in chute 50 for directing spent particles 24' directly into the quench tank.

Between flanges 162 and discharge end 166 is an annular perforated portion 167 formed within the side body members of recovery unit 50'. As the process oil drips down along the inner surfaces of discharge chute 50, this oil tends to drain through the perforations formed in the side body members of the recovery unit for collection within an annular collection chamber 170 surrounding the perforated portion. From chamber 170, the recovered process oil flows by gravity through pipe 172 into recovery tank 174 to ultimately replenish bath 14.

To prevent the shale particles 24' from colliding with the relatively fragile perforated portion 167 of recovery unit 50' as the particles rapidly descend through flow path 54, a series of deflection fingers 175 are peripherally mounted to the inner surface of the side body members above the perforated portion and project into the flow path. These fingers 175 thus channel particles 24' towards the center of the flow path to avoid collision with the perforated portion.

As mentioned above, bath 14 is maintained at a desirable level to promote refluxing action as well as establishing a slight overpressure (½ to 1 p.s.i.) within free board region 30 creating a positive pressure flow of shale oil vapors from the free board into condenser pipe 34. To prevent these shale oil vapors from entering discharge chute 50, a $CO_2$ overpressure injection valve 180 is provided preferably within the upper portion of discharge chute 50. By utilizing appropriate pressure sensors or other suitable means to monitor the pressure differential between the upper region of free board region 30 (i.e., proximate discharge opening 48) and the ambient pressure within chute 50, injection valve 180 can be actuated to discharge $CO_2$ gas into the chute to prevent shale oil vapor from entering therein.

6. Other Aspects of the Invention

During the retorting process, fine shale particles entering bath 14 from immersed compartments 18 gradually accummulate as sludge within the bottom tapered portion of housing 12. To periodically remove this sludge, a valve 182 can be opened so that the sludge flows into sludge container 184 through pipe 186. By opening outlet valve 188, the sludge can be supplied to a centrifugal separator 190 that will separate the shale fines from the process liquid in the sludge. This recovered process liquid can be used to replenish bath 14. The shale fines can be supplied to fluidized bed combusion apparatus 64 as fuel.

To prevent shale particles 24 from tumbling out of compartments 18 during rotation about the inclined axis of shaft 22, a screen or other suitable structure (not shown) can be mounted within housing 12 to cover the compartment openings except at the feed location in alignment with chute 26.

As mentioned briefly above, star valve 110 within chute 26 prevents the gravity fed particles 24 from jamming within the chute. As shown in FIG. 1, star valve 110 is fixed to a drive shaft **110*a* that can be powered by variable speed motor 20 through appropriate reduction gearing (not shown) to continuously rotate the star valve. Preferably, however, a separate variable speed motor (not shown) mounted upon housing 12 provides direct drive to output shaft 110*a* avoiding the need to synchronize rotation of the star valve with rotation of conveyor 16**.

Condenser unit 36 is capable of condensing virtually all of the evolved shale oil vapor entering conduits 38 for supply in liquid form to product oil collector 44. However, in the event that some of the shale oil enters the product collector in vapor form, a riser pipe 190 receiving these vapors includes a cooling circuit 192 to assure that these vapors are completely condensed.

The foregoing description of a preferred embodiment of the retorting system and method of the present invention has been presented for purposes of illustration and description. It is not intended to be exhaustive or to limit the invention to the precise form disclosed, and obviously, many modifications and variations are possible in light of the above teachings. For example, although not shown in the drawing, vapor outlet opening 32 is preferably formed in the top body plate 78 in vertical axial alignment with riser section **34*a* to provide a direct exit flow path for shale oil vapors passing to condenser pipe 34**. The embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

We claim:

1. A shale oil retorting system for retorting oil shale, comprising:

(a) a retort for containing a liquid bath;

(b) chute means for continuously feeding suitably sized particles of oil shale into said retort;

(c) container means including annular compartments respectively positionable below said chute means for receiving and containing said particles within the retort; and (d) means connected to the container means for rotating said container means and continuously advancing said compartments without interrupting travel thereof from (1) a feed location below said chute means for loading said compartments with particles, to (2) an immersion location downstream of said feed location wherein said particles in said compartments are placed into intimate contact with said liquid bath to evolve product vapor from said particles and to (3) a discharge location downstream from the immersion location wherein spent shale particles are unloaded from the compartments and discharged from the retort, wherein said retort includes body members joined to establish a retort housing, a lower portion of said housing containing said liquid bath, and inclined mounting means within an upper portion of said housing for supporting said container means within the housing for rotation along an inclined travel path between upper positions corresponding to said feed and discharge locations and a lower position corresponding to said immersion location, wherein said inclined mounting means includes a base plate forming an angle of greater than 90° with a horizontal reference plane, and wherein said container means includes a pair of generally cylindrical walls concentrically mounted for rotation on the base plate and connected to each other with dividers to define said annular compartments, said cylindrical walls being connected to a drive shaft rotatably mounted to said base plate, said drive shaft extending along an inclined axis about which said container means rotates.

2. The retorting system of claim 1, wherein said means for rotating said container means includes a first motor connected to said drive shaft for advancing each said compartment through 360° of rotation about said inclined axis in uninterrupted travel.

3. The retorting system of claim 2, wherein said base plate includes a discharge opening formed therein at the discharge location above the bath for unloading the spent shale particles from each compartment as each said compartment passes over said opening, and further including lower chute means having an inlet opening connected to the discharge opening and an outlet opening for discharging the spent shale particles from the retort.

4. The retorting system of claim 3, further comprising a quench tank containing a quench liquid for receiving spent shale particles from the lower chute means.

5. The retorting system of claim 3, further including stationary means fixed to said retort housing for covering said container means to prevent shale particles from tumbling out of the annular compartments during rotation about the inclined axis, said covering means including an opening aligned beneath the chute means at the feed location for loading compartments as they continuously pass therebeneath.

6. The retorting system of claim 3, wherein said lower chute means includes an annular perforated portion permitting flow therethrough of bath liquid entering the lower chute means with the spent particles, and means defining an annular collection chamber surrounding said annular perforated portion for collecting said bath liquid flowing through the perforated portion, thereby enabling recovery and recycling of the bath liquid to replenish said liquid bath.

7. The retorting system of claim 6, wherein the lower chute means is provided with a series of deflecting fingers located immediately above the annular perforated portion to deflect spent shale particles and prevent collision thereof with the perforated portion.

8. The retorting system of claim 2, further including star valve means in the chute means for feeding shale particles to prevent the particles from jamming, and a second motor connected to rotate the star valve means.

9. The retorting system of claim 8, further including means for controlling the speeds of said first and second motors in relation to each other to thereby control the amount of shale particles loaded into each said compartment.

10. The retorting system of claim 9, further including reduction gearing means connecting the first motor to the drive shaft.

11. The retorting system of claim 1, wherein said retort housing includes a vapor outlet opening in a top wall thereof for directing the product vapor evolved from said particles out of said housing, and further including primary refluxing means for condensing within said housing, vapor evolved from said liquid bath to minimize passage thereof through said vapor outlet with the product vapor.

12. The retorting system of claim 11, further including a discharge pipe connected to the vapor outlet to direct the product vapor out of said housing, and condensing means connected to an outlet of said discharge pipe for condensing said product vapor into a combustible liquid.

13. The retorting system of claim 12, wherein said primary refluxing means is upper body member of said housing having an inclined surface extending upward from and overlying the surface of the liquid bath in the direction of the vapor outlet, whereby the vapor evolved from the liquid bath contacts said upper body member and condenses against said inclined surface to drip back into said bath.

14. The retorting system or claim 13, further including secondary refluxing means for condensing the vapor evolved from the liquid bath flowing into said product vapor outlet with the product vapor, said secondary refluxing means including a portion of said discharge pipe having inner surfaces defining a discharge passage, said portion extending vertically upward from the vapor outlet for a sufficient distance so that substantially all of the vapor evolved from the liquid bath entering the product vapor outlet contacts and condenses on said inner surfaces to drip back into said bath.

15. The retorting system of claim 1, further comprising means for heating said bath to a temperature between about 700° to 800° F.

16. The retorting system of claim 1, wherein a lower body member establishing a bottom of said retort housing is inclined downward to permit fine particles of said shale particles escaping from the container means to collect as sludge at the bottom of said retort housing, and valve means for removing said sludge therefrom.

* * * * *